US006684479B2

(12) United States Patent
Wang et al.

(10) Patent No.: US 6,684,479 B2
(45) Date of Patent: Feb. 3, 2004

(54) METHOD AND APPARATUS FOR CLINCHING METAL SHEETS

(75) Inventors: Pei-Chung Wang, Troy, MI (US); Paul M. Zardus, Royal Oak, MI (US)

(73) Assignee: General Motors Corporation, Detroit, MI (US)

( * ) Notice: Subject to any disclaimer, the term of this patent is extended or adjusted under 35 U.S.C. 154(b) by 244 days.

(21) Appl. No.: 09/934,342

(22) Filed: Aug. 22, 2001

(65) Prior Publication Data

US 2003/0037428 A1 Feb. 27, 2003

(51) Int. Cl.[7] ..... B21D 39/00; B21J 5/06

(52) U.S. Cl. ..... 29/521; 29/505; 29/283.5; 219/154; 219/151

(58) Field of Search ..... 29/521, 283.5, 29/505; 219/150 R, 151, 154

(56) References Cited

U.S. PATENT DOCUMENTS 1,721,263 A * 7/1929 Tapman ..... 219/150 V
4,858,289 A * 8/1989 Speller, Sr. ..... 29/34 B
5,335,826 A * 8/1994 Kazino ..... 221/297
5,739,498 A * 4/1998 Sunamoto et al. ..... 219/78.15
6,092,270 A * 7/2000 Sawdon ..... 29/243.5
6,417,490 B1 * 7/2002 Liebrecht et al. ..... 219/157
2002/0166843 A1 * 11/2002 Wang et al. ..... 219/117.1

OTHER PUBLICATIONS

Larsson, Johnny K., "Clinch Joining—A Cost Effective Joining Technique for Body–In–White Assembly", Advanced Technologies & Processes, 1994, pp. 140–145.
Pak, Suk–Wan and Soon–Yong Kwon, "Application of Mechanical Clinching Method to Aluminum Hood", pp. 1–6.

* cited by examiner

*Primary Examiner*—David P. Bryant
(74) *Attorney, Agent, or Firm*—Kathryn A. Marra

(57) ABSTRACT

A method and apparatus for clinching metal sheets is disclosed. The apparatus includes a punch assembly for stamping indentations into stacked metal sheets and a die assembly for assisting in supporting the sheets during stamping of the indentations and for assisting in forming the indentations. The punch assembly, the die assembly or both in combination provide energy to at least a portion of the metal sheets prior to stamping. In turn, the energy elevates the temperature of the portion of the sheets such that the indentations can be more effectively formed in the portion and such that the sheets are fastened to each other with greater strength.

13 Claims, 2 Drawing Sheets

METHOD AND APPARATUS FOR CLINCHING METAL SHEETS

CROSS REFERENCE TO RELATED APPLICATIONS

This invention is related to commonly assigned and co-pending U.S. Ser. No. 10/094,128.

TECHNICAL FIELD

The present invention relates to a method and apparatus for clinching metal sheets together for assembling automotive vehicle structures.

BACKGROUND OF THE INVENTION

It is known that the manufacture of automotive vehicles often requires that metal sheets be attached to each other to form automotive vehicle structures. Clinching is one potential method of attaching such sheets. Clinching typically requires steps of stamping or otherwise cold forming corresponding indentations in at least two stacked metal sheets for frictionally or otherwise mechanically interlocking the sheets to each other. During conventional clinching processes, the metal sheets may require fairly substantial deformation of the sheets to form proper indentations. Such deformation can be particularly difficult to achieve in high strength metal sheets, which tend to be more brittle than certain lower strength metals, or require expensive heat treatment for relieving internal stresses. Therefore, there is a need for improved clinching techniques, apparatuses or both, for achieving high integrity attachment of metal sheets, particularly, sheets formed of advanced or high strength metals such as aluminum, magnesium, high strength steel and the like.

SUMMARY OF THE INVENTION

The present invention meets these needs by providing an improved method of clinching a first metal sheet to a second metal sheet, with particular utility in the formation of components for an automotive vehicle. The method involves clinching at least two sheets of metal with a punch and die assembly during or after contacting electrodes with the metal sheet for locally heating the metal sheet at the clinching locations. More specifically, the method includes a step of stacking a first metal sheet on a second metal sheet. Each of the sheets includes a first side and a second side and at least a portion of the second side of the first sheet is in overlapping contact with at least a portion of the first side of the second sheet for forming an overlapped region. Once the sheets are stacked, the first and second metal sheets are placed between a punch assembly and a die assembly. The punch assembly includes a punch surrounded by a first electrode, wherein the first electrode is adapted for contacting the first sheet. The die assembly includes a die surrounded by a second electrode, wherein the second electrode is adapted for contacting the second sheet. The first and second electrodes are each connected to an electrical energy source. Upon contacting the first and second electrodes with the metal sheets, the electrical energy source is capable of inducing an electrical current that flows between the first and second electrodes and the first and second metal sheets to elevate the temperature of the overlapped region of the first sheet and the second sheet. Mating indentations are punched within the overlapped region for additionally securing the first sheet to the second sheet. During formation of the indentations, an outer periphery of one of the indentations at least partially bonded to an inner periphery of another of the indentations. Additionally, the clinching die provides force to clinch the inner periphery onto the outer periphery.

The present invention also provides an apparatus for clinching a first metal sheet to a second metal sheet. The apparatus includes a punch assembly for stamping mating indentations in the first and second metal sheet while the first sheet is stacked upon the second sheet. The punch assembly includes a cylindrical punch moveable between at least a first position and a second position for forming the indentations. The punch assembly further includes a first electrode associated with the punch. A die assembly is also included in the apparatus for at least partially supporting the first and second sheets as the punch assembly stamps the indentations into the sheets. The die assembly includes a central cylindrical die defining a cup-shaped cavity for assisting in forming the indentations. The die assembly also includes an associated second electrode. The apparatus further includes an electrical energy source electrically connected to the first electrode and the second electrode for inducing a current between the first and second electrode and through the first and second sheets for elevating the temperature of portions of the first and second sheets prior to or during punching of the indentations into the portions.

The present invention thus provides an improved clinching apparatus and clinching technique for providing structurally improved indentations in stacked sheets thereby more securely fastening the sheets together. The ability to locally control the temperature of the sheets makes this invention particularly advantageous for the joining of high strength metals.

BRIEF DESCRIPTION OF THE DRAWINGS

These and other aspects and advantages of the present invention will become apparent upon reading the following detailed description in combination with the accompanying drawings, in which.

DETAILED DESCRIPTION OF THE PREFERRED EMBODIMENT

Figure 1:
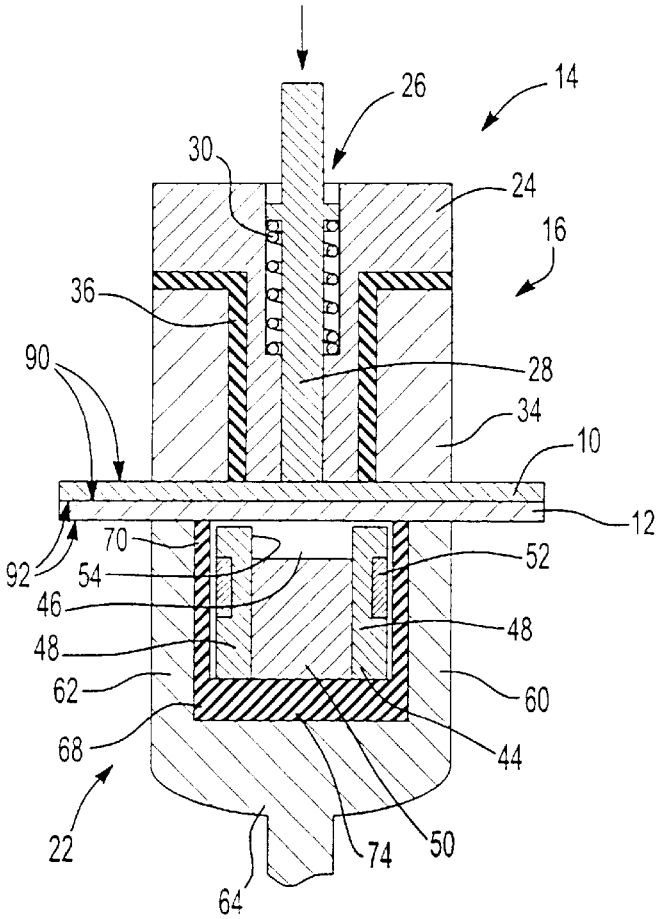
FIG. 1 is a sectional view of a clinching apparatus prior to clinching a pair of stacked metal sheets to each other.
Figure 2:
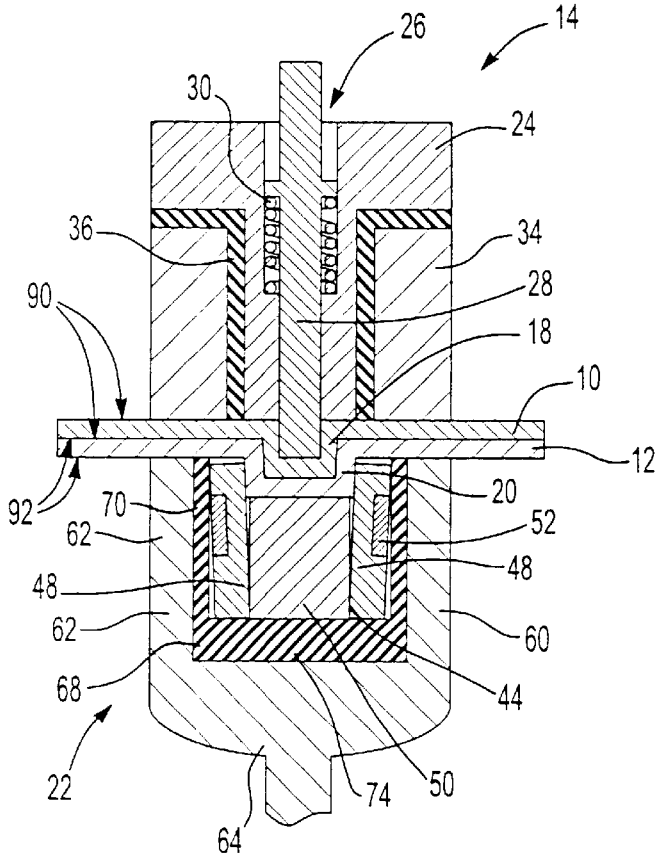
FIG. 2 is a sectional view of the clinching apparatus of FIG. 1 during clinching of the pair of stacked metal sheets to each other.

Referring to FIGS. 1 and 2, a first metal sheet 10 is clinched to a second metal sheet 12 by a clinching apparatus 14. The clinching apparatus 14 includes a punch assembly 16 for stamping generally cup-shaped or generally cylindrical mating indentations 18, 20 into the metal sheets 10, 12 and a die assembly 22 for supporting the metal sheets 10, 12 and for assisting in the stamping or forming of the indentations 18, 20.

The punch assembly 16 includes a generally elongated metal stripper 24 having an opening 26 extending down a length of the stripper 24. An elongated cylindrical steel punch 28 of the assembly 16 is received in the opening 26 and the punch 28 is moveable along a length of the opening 26 between at least a first position, as shown in FIG. 1, and a second position, as shown in FIG. 2. The punch 28 may be moved hydraulically, mechanically, electrically, pneumatically or otherwise. Preferably, the punch assembly 16 also includes a spring 30 attached to the stripper 24, the punch 28 or both that is biased against the motion of the punch 28 from its first to its second position for assisting in retracting the punch 28 after clinching as further described below.

A copper electrode 34 of the punch assembly 16 is generally annular and surrounds at least a portion of the stripper 24 and the hole 26 through which the punch 28 moves. A generally annular insulator 36 of the punch assembly 16 is disposed between the stripper 24 and the electrode 34 to electrically separate the electrode 34 from the stripper 24 and the punch 28. The insulator 36 may be formed of an insulative material such as a plastic, polymer, ceramic, or the like. In one preferred embodiment, the insulator 36 is a laminate formed with a fabric or paper molded with a synthetic resin.

In FIGS. 1 and 2, the punch 28, the hole 26, the spring 30, the insulator 36 and the electrode 34 are generally cylindrical, coaxial or both about an axis (not shown) extending centrally along their lengths. Preferably, a housing (not shown) can be used to fasten the electrode 34, the insulator 36, and the stripper 24 together. Alternatively, other conventional fasteners or fastening techniques may be used.

The die assembly 22 includes a generally cylindrical die 44 having a central cylindrical opening or cavity 46. Preferably, the cylindrical die 44 includes three clinching blades 48 that are positioned in an annular arrangement to substantially surround a central cylindrical member 50. Also preferable, an elastic band 52 surrounds the clinching blades 48 to maintain the blades 48 around the central member 50. As seen, the blades 48 form a generally annular and cylindrical wall 54 for defining the cavity 46. Alternatively, however, other dies may replace the die 44 shown. For example, the die 44 may be formed as a single part providing a cavity defined by a sloping annular wall for forming the cavity in a frusto-conical shape.

The die assembly 22 further includes a generally cup shaped electrode 60 with an annular portion 62 and a base portion 64 that cooperatively define a cavity for receiving the die 44. Preferably, the die assembly 22 also includes a generally cup-shaped insulator 68 with an annular portion 70 and a base portion 74 defining a cavity wherein the insulator 68 is formed of a material similar to the material of the insulator 36 of the punch assembly 16. As shown, the insulator 68 fits flush within the cavity of the electrode 60 and the die 44 is received in the cavity of the insulator 68 for electrically separating the die 44 from the electrode 60. By changing the dimensions of the insulator 68, the die 44 or both, a variety of different dies having a variety of different sized or shaped cavities may be interchanged within the cavity of the electrode 60 if desired. The components of the punch assembly 16 and the die assembly 22 may be fastened together as desired by conventional fasteners, adhesives, a housing and the like.

Figure 3:
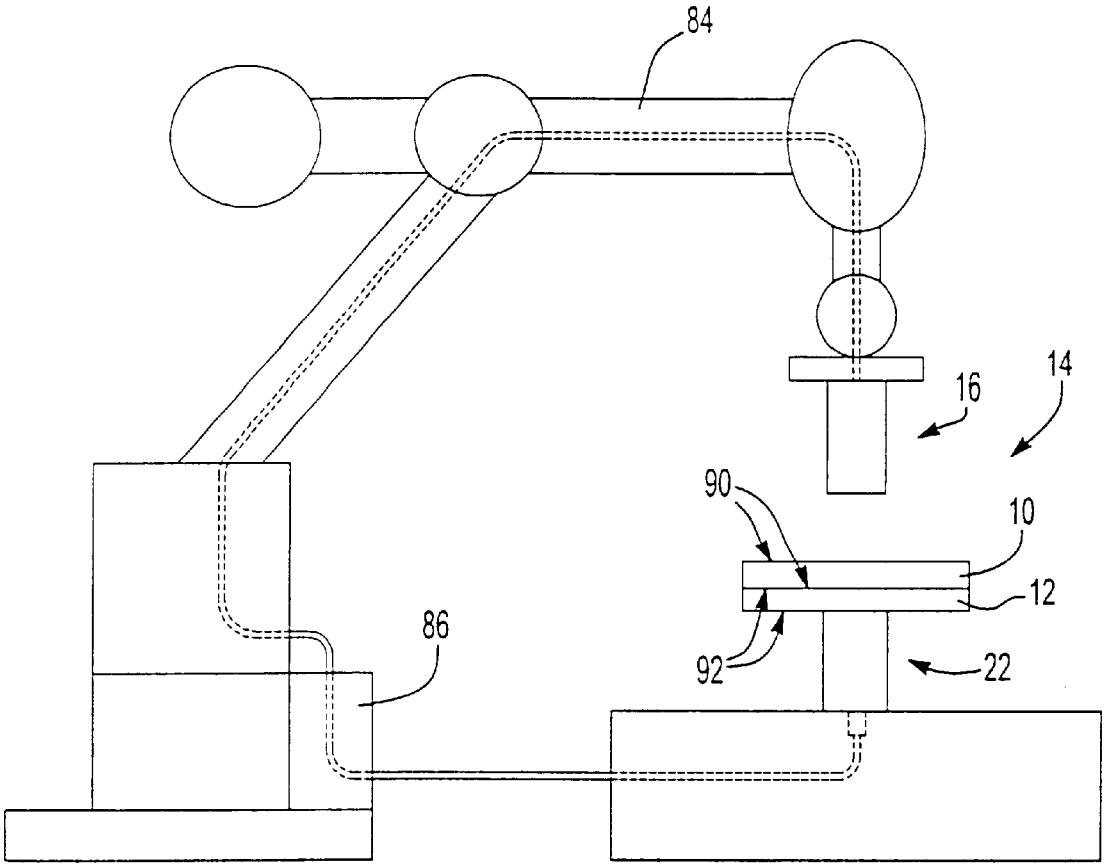
FIG. 3 illustrates the clinching apparatus of FIGS. 1 and 2 with a robot arm and an energy source.

The punch assembly 16, the die assembly 22 or both may be mounted to various apparatus for moving the punch assembly 16 or the die assembly 22 relative to each other, such as robots, C-frames and hard tooling such as a die set. In the exemplary embodiment shown in FIG. 3, the punch assembly 16 is attached to a robot arm 84 that can move the punch assembly 16 as needed or desired. The die assembly 22 is stably positioned adjacent the robot arm 84.

An energy source 86 such as a transformer or other energy source is electrically coupled to the electrodes 34, 60 of the punch assembly 16 and the die assembly 22 for providing electrical current to those electrodes 34, 60.

Referring to FIGS. 1 and 2, the first metal sheet 10 and second metal sheet 12 each include a first side 90 and a second side 92. The first sheet 10 is stacked upon the second sheet 12 such that at least a portion of the second side 92 of the first sheet 10 is in substantially continuous contact with at least a portion of the first side 90 of the second sheet 12 at a location for forming the indentations 18, 20. The sheets 10, 12 may be formed of several metals. Preferably, the sheets 10, 12 are formed of a high strength or advanced metal such as aluminum, magnesium, high strength steel or the like with thicknesses ranging between 0.6 mm and 3.0 mm although thicker of thinner sheets may also be used.

The stacked sheets 10, 12 are placed between the punch assembly 16 and the die assembly 22 of the clinching apparatus 14. Preferably, the sheets 10, 12 are placed upon the die assembly 22 such that the second side 92 of the second sheet 12 contacts the die assembly 22. Thereafter, the punch assembly 16 is contacted with first side 90 of the first sheet 10 (e.g., using the robot arm 84 or another apparatus) to clamp the sheets 10, 12 between the punch assembly 16 and the die assembly 22.

When the sheets 10, 12 are clamped between the assemblies 16, 22, the electrode 34 of the punch assembly 16 is in contact with the first side 90 of the first sheet 10 and the electrode 60 of the die assembly 22 is in contact with the second side 92 of the second sheet 12. The energy source 86 induces an electric current that flows between the two electrodes 34, 60 through each of the sheets 10, 12. Advantageously, the current may be applied for as short as about 1/30 of a second using about 20 kiloamps of electricity for aluminum, however, different levels of energy may be used for different amounts of time depending on the application. The current provides energy to the sheets 10, 12 thereby elevating the temperature of (i.e., resistive heating) at least a portion of each of the sheets 10, 12 (i.e., the overlapped region) to a desired temperature. Preferably, the heated portions are the portions in which the indentations 18, 20 are to be formed.

Thereafter, the punch 28 is moved from its first position to its second position as shown in FIG. 2 to form the indentations 18, 20 in mating relation to each other (i.e., the indentation 18 in the first sheet 10 is securely fit within the indentation 20 in the second sheet 12) in the heated portions. As the indentations 18, 20 are stamped into the sheets 10, 12, the wall 54 of the clinching die 44 provides force against the outer periphery of the indentation 20 in the second sheet 12 to clinch the inner periphery of the indentation 20 in the second sheet 12 about the outer periphery of the indentation 18 in the first sheet 10 thereby forming a joint. In the embodiment wherein a plurality of clinching blades 48 are surrounded by the elastic band 52, the blades 48 may flex slightly outward to assist in forming and clinching the indentions 18, 20. After formation of the indentations 18, 20, the spring 30 retracts the punch 28 from the indentations 18, 20 such that the sheets 10, 12 may be removed from the die assembly 22 together.

Advantageously, clinching the sheets 10, 12 after heating the portions of the sheets 10, 12 to be clinched allows the indentations 18, 20 to be more easily formed without causing the structural defects that can be caused by cold forming techniques. Additionally, the heated inner periphery of the indentation 20 in the second sheet 12 tends to bond or weld to the heated outer periphery of the indentation 18 in the first sheet 10 thereby further securing the first sheet 10 to the second sheet 12.

Although, the assemblies shown use electrodes coupled to an electrical energy source, it is contemplated that other energy sources suitable for locally treating the indented sheets, such as lasers (e.g., carbon dioxide or N:Yag lasers) may be attached to or form part of the punch assembly 16, the die assembly 22 or both. It is further contemplated that the electrodes 34, 60 may not surround the punch 28 or die 44, but may be otherwise associated with or adjacent the punch 28 or die 44 or that the electrodes 34, 60 may be integrally formed as the punch 28 or die 44.

The method and apparatus described above may be used for attaching several different automotive components that have sheet metal or sheet metal portions. Examples include peel joints, lap joints, various vehicle panels such as door panels, decklids, hoods, sunroof applications and the like. Furthermore, the overlapped regions of the sheets may be continuously bonded or intermittently bonded over some or all of its area.

Advantageously, clinching according to the present invention is inexpensive, can improve joint consistency, and can extend the life of tooling used to make the clinched joints.

It should be understood that the invention is not limited to the exact embodiment or construction which has been illustrated and described but that various changes may be made without departing from the spirit and the scope of the invention.

What is claimed is:

1. A method of clinching a first member to a second member comprising:

(a) stacking a first member on a second member, wherein each of said members has a first side and a second side, and at least a portion of said second side of said first member is in overlapping contact with at least a portion of said first side of said second member for forming an overlapped region;

(b) placing said first and second members between a punch assembly and a die assembly, said punch assembly including a punch surrounded by a first electrode for contacting said first member, said die assembly including a die surrounded by a second electrode for contacting said second member, said first and second electrodes each connected to an electrical energy source wherein at least one of said punch assembly and said die assembly is electrically separated from the respective electrode;

(c) inducing an electrical current with said electrical energy source, said current flowing between said first and second electrodes and through said first and second members for heating said overlapped region of said first sheet and said second sheet; and (d) punching mating indentations within said overlapped region of said first member and said second member with said punch assembly for securing said first member to said second member, an outer periphery of one of said indentations at least partially bonding to an inner periphery of another of said indentations during formation of said indentations, said clinching die providing force to clinch said inner periphery onto said outer periphery.

2. A method as in claim 1, wherein said punch assembly further includes a spring for assisting in retracting said punch after forming said indentations.

3. A method as in claim 1, wherein said punch is hydraulically actuated for punching said indentations in said members.

4. A method as in claim 1, wherein said punch assembly includes an insulator electrically separating said punch of said punch assembly from said first electrode.

5. A method as in claim 1 wherein said die assembly includes an insulator electrically separating said die of said die assembly from said second electrode.

6. A method as in claim 1, wherein said punch assembly includes an insulator electrically separating said punch of said punch assembly from said first electrode and said die assembly includes an insulator electrically separating said die of said die assembly from said second electrode.

7. An apparatus for clinching a first member to a second member, said apparatus comprising:

(a) a punch assembly for stamping mating indentations in said first and second members while said first member is stacked upon said second member, said punch assembly including a cylindrical punch moveable between at least a first position and a second position for forming said indentations, said punch assembly further including a first electrode associated with said punch;

(b) a die assembly for at least partially supporting said first and second members as said punch assembly stamps said indentations into said members, said die assembly including a central cylindrical die defining a cup-shaped cavity for assisting in forming said indentations, said die assembly including a second electrode associated with said die wherein at least one of said punch assembly and said die assembly is electrically separated from the respective electrode; and (c) an electrical energy source electrically connected to said first electrode and said second electrode for inducing a current between said first and second electrode and through said first and second members thereby elevating the temperature of portions of said first and second members prior to punching said indentations into said portions.

8. An apparatus as in claim 7, wherein said punch assembly further includes a spring for assisting in retracting said punch after forming said indentations.

9. An apparatus as in claim 7, wherein said punch is adapted for hydraulic actuation between said first position and said second position for punching said indentations in said members.

10. An apparatus as in claim 7, wherein said punch assembly includes an insulator for electrically separating said punch of said punch assembly from said first electrode.

11. An apparatus as in claim 7, wherein said die assembly includes an insulator for electrically separating said die of said die assembly from said second electrode.

12. An apparatus as in claim 7, wherein said punch assembly includes an insulator for electrically separating said punch of said punch assembly from said first electrode and wherein said die assembly includes an insulator for electrically separating said die of said die assembly from said second electrode.

13. An apparatus for clinching a first member to a second member, comprising:

(a) a punch assembly for stamping mating cup shaped indentations in said first and second members while said first member is stacked upon said second member, said punch assembly including:

i) a cylindrical punch moveable between at least a first position and a second position for forming said indentations;

ii) a generally cylindrical stripper that is cylindrical about a centrally located axis, said stripper having a cylindrical hole that is coaxial with said axis and extends down the center of said stripper for receiving said punch;

iii) a cylindrical first electrode surrounding at least a portion of said stripper, said first electrode for contacting and supplying electricity to said members to heat said members prior to stamping said indentations in said members; and iv) an insulator disposed between said first electrode and said stripper for electrically separating said first electrode from said first stripper; and (b) a die assembly for at least partially supporting said first and second members as said punch assembly stamps said indentations into said members, said die assembly including;

i) a central cylindrical die having a central cylindrical member surrounded by a plurality of clinching blades, said clinching blades surrounded by an elastic band for allowing said blades to be biased outward, said central die further defining a generally cylindrical cavity;

ii) a cup shaped second electrode for conducting electricity with said first electrode, said second electrode having a generally cylindrical cavity for receiving said die and said blade;

iii) a cup shaped insulator for electrically separating said second electrode from said die, said insulator receiving said die in a cavity within said insulator, said insulator being receivable within said cavity of said electrode; and iv) an energy source for inducing an electrical current across said electrodes.

* * * * *